US005441163A

United States Patent [19]

Carrasco

[11] Patent Number: 5,441,163

[45] Date of Patent: Aug. 15, 1995

[54] PORTABLE TOOL CONTAINER

[76] Inventor: Ray Carrasco, 3997 Brookside Dr., Lake Havasu City, Ariz. 86406

[21] Appl. No.: 223,773

[22] Filed: Apr. 6, 1994

[51] Int. Cl.[6] ..... A65D 75/00

[52] U.S. Cl. ..... 220/23.86; 220/336; 220/553; 220/759; 206/506; 206/373

[58] Field of Search ..... 220/23, 86, 336, 553, 220/759; 206/506, 507, 373

[56] References Cited

U.S. PATENT DOCUMENTS

| | | | |
|---|---|---|---|
| 2,314,835 | 3/1943 | Jowns et al. . | |
| 2,949,951 | 8/1960 | Schoen | 220/336 |
| 3,352,445 | 11/1967 | Cochin | 220/336 |
| 3,751,845 | 8/1973 | Van Leeuwen . | |
| 4,450,974 | 5/1984 | Winden | 220/336 |
| 4,513,974 | 4/1985 | Lin | 220/336 |
| 5,011,013 | 4/1991 | Meisner et al. . | |
| 5,125,183 | 6/1992 | Tisdell . | |
| 5,154,303 | 10/1992 | Jordan . | |
| 5,186,329 | 2/1993 | Fogelberg . | |

*Primary Examiner*—Joseph Man-Fu Moy

*Attorney, Agent, or Firm*—Parsons & Associates; Robert A. Parsons; Don J. Flickinger

[57] ABSTRACT

A portable tool container including a cylindrically shaped base with a flat bottom and sides defining an upwardly opening main compartment. A plurality of trays are affixed to the sides of the base in stacked relationship for pivotal movement between a closed position overlying the main compartment and an open position in which the trays operate as counterweights to maintain the base securely in an upright position. A cover attached to an upper one of the trays and pivotal between a closed position overlying the upper one of the trays and an open position allowing access to all of the trays. A tubular member affixed within the main compartment and positioned to be coaxial with coaxial openings in the trays and the cover in the closed position and to receive an elongated tubular tank for a torch, the tank locking the trays and the cover in the closed position.

20 Claims, 2 Drawing Sheets

FIG. 1
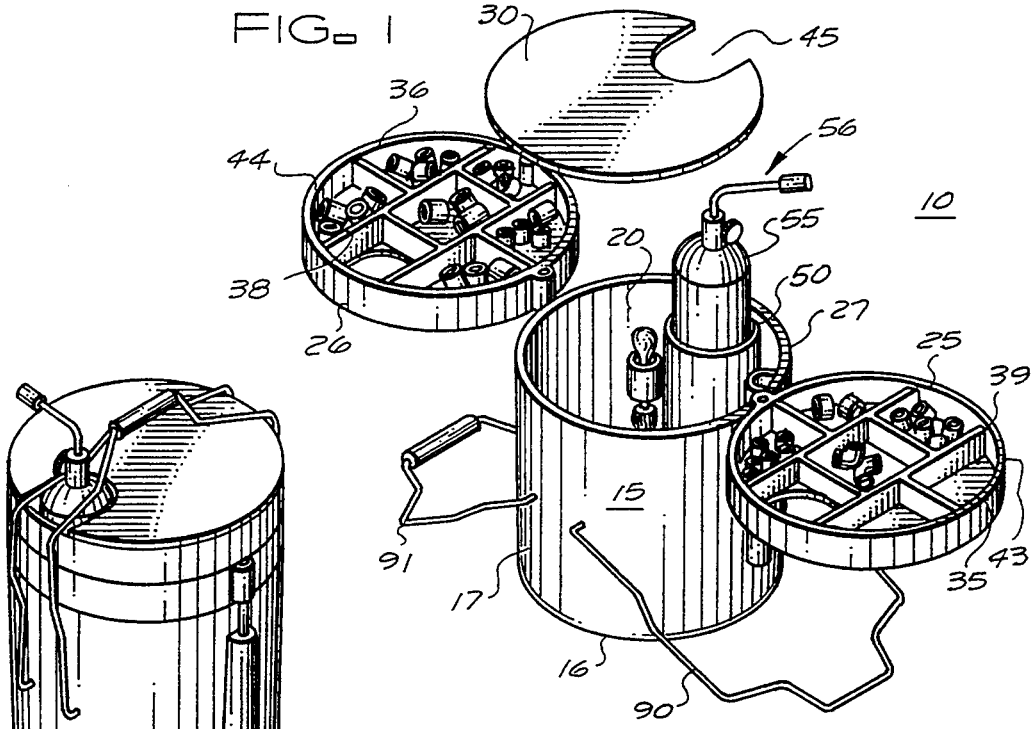
FIG. 2
FIG. 3
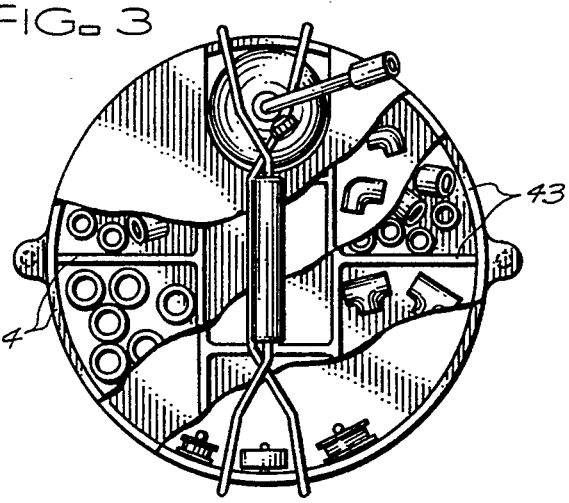
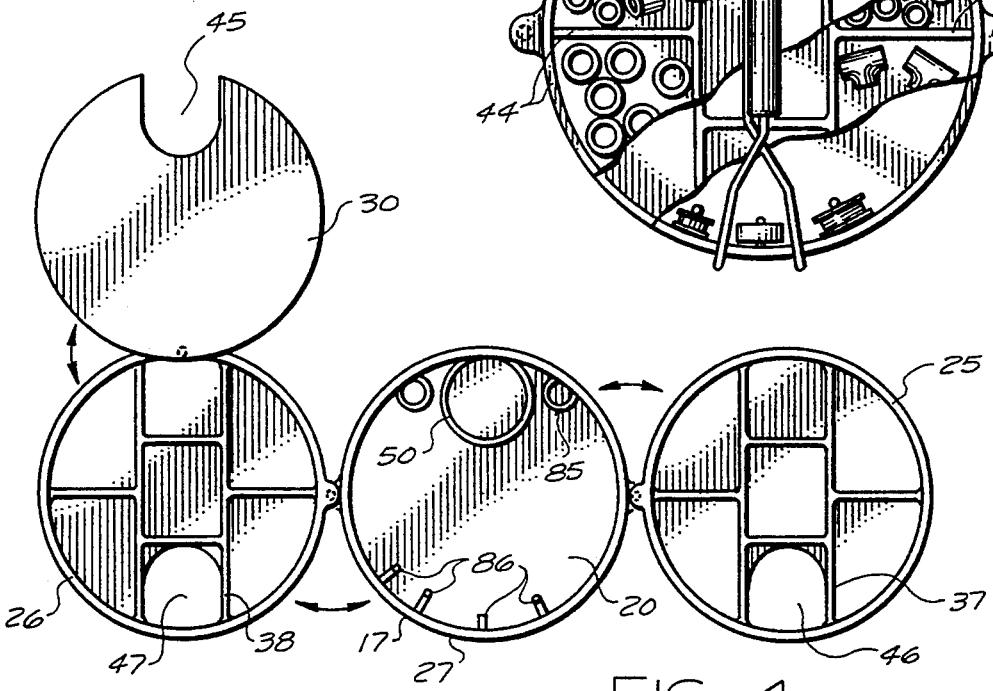
FIG. 4

PORTABLE TOOL CONTAINER

BACKGROUND OF THE INVENTION

1. Field of the Invention

This invention relates to containers for storing and transporting tools during and between jobs.

More particularly, the present invention relates to a portable tool container.

In a further and more specific aspect, the instant invention concerns an improved portable tool container and the use of the container and tools by various craftsmen during jobs.

2. Prior Art

In the prior art, there are several common problems, either prior art tool containers are large, heavy and cumbersome or they are inconvenient and difficult to use. For example, tool chests are known which contain a plurality of drawers. Because of the size and construction these chests are almost always constructed from heavy metal and are, therefore, extremely heavy and difficult to carry around. The craftsman using such tool chests must either be very young and strong or must have some additional structure or wheeled device to transport the chest. Such apparatus is expensive and inconvenient to carry to work sites that are difficult to get to, such as upper floors in houses, apartments and the like.

Further, in many instances these prior art tool chests are unstable and must be carefully balanced or propped up before more than one of the drawers can be opened, at the same time. Also, in many chests, only one drawer can be opened at a time because successive drawers conceal the draw below. Generally, to solve these problems the craftsman must be sure to open only one drawer at a time and to close the drawer before opening another one. This is inconvenient and time consuming, especially if the craftsman uses more than one tool at a time or maintains a supply of hardware in the drawers for use on the job.

In another example, tool buckets have been suggested. In this structure a bucket-like container is used with one or two removable trays formed to fit into the upper end of the bucket. Generally, in the tool bucket type of device larger tools are simply stored in a loose mode in the bottom of the bucket and smaller tools and hardware are stored in the trays. The tool bucket is very inconvenient because the craftsman must remove all of the trays at each job, to gain access to the tools in the bottom of the bucket. This means that the trays are setting around in the way, which requires a large amount of space just to gain access to the tools. Also this is inconvenient for the craftsman since he must go through the complete unloading process even if the job only requires a single screwdriver of wrench.

Also, in most of these prior art tool containers there is insufficient room for large tools, such as acetylene torches and the like. Many craftsmen, such as plumbers and the like, require an acetylene torch as a standard piece of equipment. Prior art tool containers which are too small, or which incorporate drawers that are too small to accommodate an acetylene torch, require the craftsman to carry the acetylene torch separately. This is extremely inconvenient and, in the case of the large tool chest, may mean that the craftsman will have to make two or more trips from a vehicle to the work site or, in the case of the tool bucket, may mean that the craftsman will have to carry the acetylene torch in his free hand, making it difficult to open doors, etc.

It would be highly advantageous, therefore, to remedy the foregoing and other deficiencies inherent in the prior art.

Accordingly, it is an object of the present invention to provide an improved portable tool container.

Another object of the present invention is to provide an improved portable tool container that is relatively simple to operate.

And another object of the present invention is to provide an improved portable tool container that can be used to retain tools and hardware conveniently for craftsmen.

Still another object of the present invention is to provide an improved portable tool container which is simpler to fabricate than other tool containers.

Yet another object of the present invention is to provide an improved portable tool container which is lighter than prior art tool containers.

And still another object of the present invention is to provide an improved portable tool container which is less expensive to fabricate and easier to use than prior art work holders.

A further object of the present invention is the provision of an improved portable tool container which can be used with a variety of tools, including acetylene torches and the like, by a variety of craftsmen.

And a further object of the present invention is the provision of an improved portable tool container which is more versatile than prior art work holders.

SUMMARY OF THE INVENTION

Briefly, to achieve the desired objects of the instant invention, in accordance with a preferred embodiment thereof, provided is a portable tool container including a generally cylindrically shaped base with a flat bottom and sides defining an upwardly opening main compartment. A plurality of trays are hingedly affixed to the sides of the base in opposed and stacked relationship for pivotal movement between a closed position overlying the upwardly opening main compartment and an open position in which the plurality of trays pivot outward from the sides of the base in different directions and operate as counterweights to maintain the base securely in an upright position. A cover is pivotally attached in overlying relationship to an upper one of the plurality of trays and pivotal between a closed position in which the cover overlies the upper one of the trays and an open position in which the cover extends outwardly to allow access to all of the plurality of trays.

In accordance with a further embodiment of the invention a portable tool container as described above is provided wherein the plurality of trays and the cover each have an opening defined therethrough which openings are coaxially aligned through the plurality of trays and the cover into the main compartment when the plurality of trays and the cover are all in the closed position. A generally tubular member is affixed within the main compartment in an upright orientation and further positioned to be coaxial with the coaxial openings in the plurality of trays and the cover in the closed position for receiving, for example, an elongated tubular tank such as used with an acetylene torch, the elongated tubular tank, when in position, locks the plurality of trays and the cover in the closed position.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 is a perspective view of a portable tool container, in the open position, constructed in accordance with the present invention;

FIG. 2 is a perspective view of the portable tool container of FIG. 1 in the closed position;

FIG. 3 is an enlarged view in top plan of the portable tool container of FIG. 2 in the closed position, portions thereof broken away;

FIG. 4 is a view in top plan of the portable tool container of FIG. 1 in the open position;

DETAILED DESCRIPTION OF THE PREFERRED EMBODIMENTS

Figure 5:
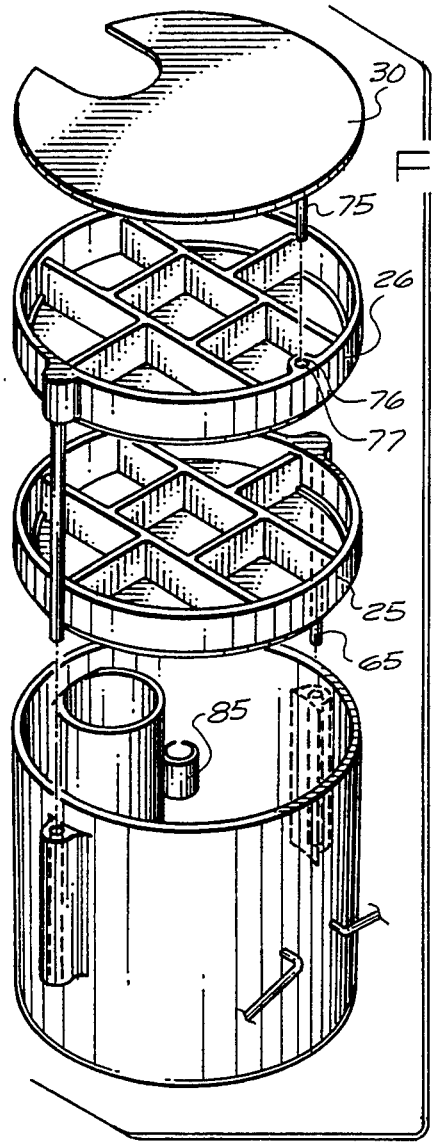
FIG. 5 is an exploded perspective view of the portable tool container of FIG. 3.

Turning now to the drawings in which like reference characters indicate corresponding elements, attention is first directed to FIG. 1 which illustrate a portable tool container 10 in accordance with the present invention. Portable tool container 10 includes a base 15 which is generally cylindrical shaped and in this specific embodiment is tubular with a round cross-section. It should be understood that while cylindrical base 15 is illustrated herein as tubular with a round cross-section many other configurations are possible, including rectangular, square, etc.

Base 15 has a flat bottom 16 and sides 17 which in this specific embodiment are integrally formed of a single piece. Bottom 16 and sides 17 define an upwardly opening main compartment 20 therein. In a preferred embodiment, base 15 is molded of plastic which is very light and strong and which makes fabrication relatively simple. A plurality of trays 25 and 26 are hingedly affixed to sides 17 of base 15 for pivotal movement between an open position, illustrated in FIG. 1, and a closed position, illustrated in FIG. 2. Trays 25 and 26 are attached in opposed relationship on opposite outer surfaces of sides 17. Further, trays 25 and 26 are positioned in a stacked relationship with tray 25 immediately adjacent an upper edge 27 of sides 17 and tray 26 positioned above and in overlying relationship (in the closed position) to tray 25.

It will be understood that only two trays are illustrated in this embodiment, but that virtually any number of trays can be provided. Further, because only two trays are illustrated herein for purposes of example, trays 25 and 26 are attached to opposite outer surfaces of sides 17. If additional trays are provided, the spacing between attachment points will generally be equidistant about sides 17, with three trays being attached approximately 120° apart, four trays being attached at 90° points, etc. Spacing of the trays in this manner, allows each tray to act as a counter balance to the others when in the open position.

Also, a cover 30 is pivotally attached to upper tray 26 and is pivotal, with respect to tray 26, between an open position, illustrated in FIG. 1, and a closed position, illustrated in FIG. 2. Each tray 25 and 26 has a cylindrical side wall 35 and 36, respectively, forming an upwardly opening compartment and a plurality of partitions 37 and 38, respectively dividing each of the compartments into a plurality of minor compartments. Side walls 35 and 36 have upper edges 43 and 44, respectively, forming a plane parallel to but space upwardly from edge 27 of base 17. It is convenient, for inexpensive and easy fabrication, to mold trays 25 and 26 from plastic or the like. In the closed positions, tray 25 overlies main compartment 20 and rests on upper edge 27 of sides 17 to completely close main compartment 20. Tray 26 overlies tray 25 and rests on upper edge 43 thereof to completely close tray 25 and cover 30 overlies tray 26 and rests on upper edge 44 thereof to completely close tray 25, as illustrated in FIG. 3, thereby preventing the egress of any hardware, tools or other material stored in container 10 or movement of hardware and the like between minor compartments in trays 25 and 26.

Cover 30 has a flat disk shaped configuration with a notch or opening 45 defined therethrough. Also, as can be seen most clearly in FIG. 4, tray 25 has an opening 46 therethrough and tray 26 has an opening 47 therethrough. A portion of partition 37 surrounds and compartmentalizes opening 46 to prevent hardware and the like from moving from tray 25 to tray 26. Also, a portion of partition 38 surrounds and compartmentalizes opening 47 to prevent hardware and the like from moving from tray 26 to main compartment 20 in base 15. Openings 45, 46 and 47 are positioned to be coaxially aligned when trays 25 and 26 and cover 30 are pivoted into the closed position.

A generally tubular member 50 is affixed in main compartment 20 within base 15 by some convenient means, such as gluing, molding with base 15, etc. Tubular member 50 25 and 26 and cover 30 are pivoted into the closed position. Tubular member 50 has an inner diameter slightly larger than the outer diameter of an elongated tubular tank 55 for an acetylene torch 56. Also, openings 45, 46 and 47 have a diameter approximately equal to the inner diameter of tubular member 50 so that acetylene torch 56, with tank 55, can be easily and conveniently placed in tubular member 50 or extracted from tubular member 50 with trays 25 and 26 and cover 30 in the closed position. Further, the height of acetylene torch 56 and tank 55 is such that trays 25 and 26 and cover 30 are effectively locked in the closed position when acetylene torch 56 and tank 55 are stored in tubular member 50.

Figure 6:
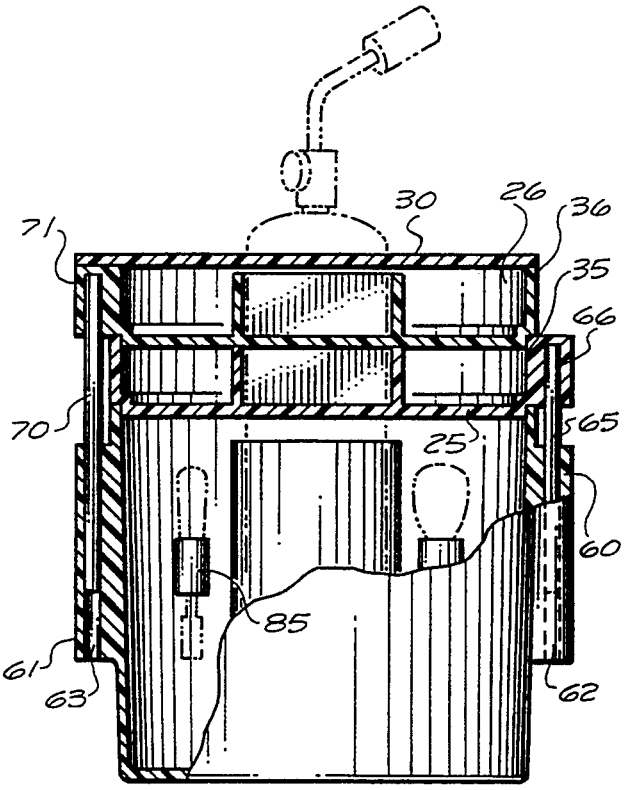
FIG. 6 is an enlarged side elevational view of the portable tool container of FIG. 5 assembled and in the closed position, portions thereof broken away and shown in section.

In this specific embodiment, base 15 is formed with radially outwardly projecting elongated ears 60 and 61 which extend longitudinally (vertically) along the outer surface of sides 17 of base 15 and are equally spaced therearound. Each ear 60 and 61 has an opening 62 and 63, respectively, extending longitudinally therethrough. As can be seen in FIGS. 5 and 6, tray 25 has an elongated rod 65 fixedly engaged in a projection 66 affixed to an outer surface of wall 35 so as to extend vertically downwardly. Rod 65 is engaged in opening 62 of ear 60 so as to mount tray 25 for pivotal movement about ear 60. In a similar fashion, tray 26 has an elongated rod 70 fixedly engaged in a projection 71 affixed to an outer surface of wall 36 so as to extend vertically downwardly. Rod 70 is engaged in opening 63 of ear 61 so as to mount tray 26 for pivotal movement about ear 61. Rods 65 and 70 may be fixedly engaged in projections 66 and 71 by initially molding them into projections 66 and 71, by threading them into the projections, etc.

Cover 30 has a downwardly projecting rod 75 engaged in the lower surface thereof by any convenient means, such as threading, gluing, etc. Cover 30 may be formed of plastic, metal, etc. and rod 75 can be conveniently engaged therein by any means corresponding with the type of material utilized to form cover 30. An inwardly projecting ear 76 is formed in tray 26 and a vertically extending opening 77 is formed therein. Cover 30 is then pivotally mounted by simply engaging rod 75 in opening 77.

Figure 7:
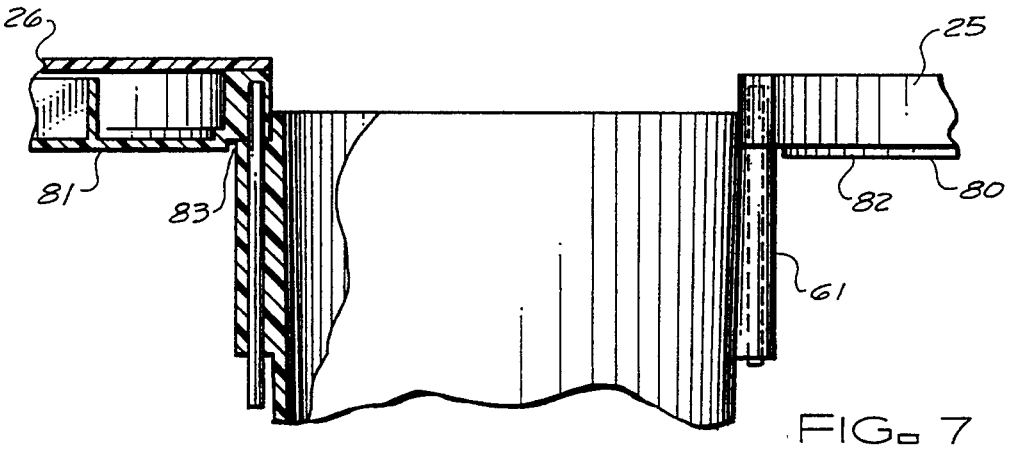
FIG. 7 is and enlarged side elevational view of the portable tool container of FIG. 6 in the open position, portions thereof broken away and shown in section and portions thereof removed.

It can be seen, especially be referring to FIGS. 6 and 7, that trays 25 and 26 are formed so that major bottom surfaces 80 and 81 of each tray 25 and 26, respectively, is slightly lower than the lower edge of circumferentially extending walls 35 and 36. This forms a circumferentially extending notch 82 and 83 around the lower periphery of each tray 25 and 26, respectively. Notches 82 and 83 are formed so as to have an outer diameter slightly smaller than the inner diameter of walls 17 of base 15 and wall 36 of tray 26, respectively. Also, the upper edges of partitions 37 and 38 are slightly reduced in height. Thus, as can be seen most clearly in FIG. 6, when tray 25 is positioned in overlying relationship on base 15, notch 82 nestingly engages the upper edge of walls 17 to prevent further pivotal movement. Also, when tray 26 is positioned in overlying relationship on tray 25, notch 83 nestingly engages the upper edge of wall 35 to prevent further pivotal movement and lower major surface 81 engages the upper edges of partitions 37 to add strength and stability to the trays. This nesting, or stacking, feature adds strength to container 10 and prevents inadvertent pivotal movement during transportation or use.

In addition to tubular member 50 in main compartment 20, other tubular members 85 may be affixed to the inner surface of walls 17 for receiving and conveniently holding special tools, or tools which are most commonly or frequently used. Also, inwardly projecting pegs and/or clips 86 (see FIGS. 3 and 4) can be provided on the inner surface of major compartment 20 for holding commonly used hardware, such as solder, tape, etc. or special tools.

A pair of mating handle portions 90 and 91 are pivotally affixed to the outer surface of sides 17 of base 15, as best illustrated in FIGS. 1 and 2. Handle portions 90 and 91 are formed of an elongated rod or piece of heavy wire and are pivotally mounted by engaging opposite ends of the rod or wire into holes in the surface of base 15. The holes are positioned in opposed relationship so that if the rod or wire has some resiliency the ends will be spring biased into the holes. When handle portions 90 and 91 are pivoted upwardly into mutual engagement, as illustrated in FIGS. 2 and 3, cover 30 is engaged and held tightly in the closed position. Since trays 25 and 26 are positioned in a stacked or nesting relationship, they also are held fixedly in the closed position by the mutual engagement of handle portions 90 and 91. Handle portions 90 and 91 are also positioned to engage the upper end of tank 55 of acetylene torch 56 and hold tank 55 firmly in the stored position when handle portions 90 and 91 are mutually engaged.

Accordingly, an improved portable tool container is disclosed which is simpler and less expensive to fabricate than other tool containers. Further, the improved portable tool container can be used to retain tools and hardware conveniently for craftsmen and is simpler to use. The improved portable tool container is lighter than prior art tool containers can be used with a variety of tools, including acetylene torches and the like, by a variety of craftsmen. Further, because the plurality of trays are mounted on the base so as to pivot about points equally spaced about the side of the base and because the trays pivot outwardly in different directions, the trays operate as counterweights to maintain the base securely in an upright position.

Several advantages of the disclosed portable tool container are the simplicity and ease of fabrication and the great versatility. Also, because of the nesting or stacking of the trays additional strength and security are provided. Further, special tools, such as an acetylene torch, can be conveniently stored in the portable tool container so that it can be easily carried with other tools and is convenient for instant use.

Various modifications and changes to the embodiments herein chosen for purposes of illustration will readily occur to those skilled in the art. For example, base 15 can be formed and assembled in a variety of ways while still performing the stated functions. Further, a variety of different materials may be utilized to form base 15 and trays 25 and 26 and a variety of apparatus may be fabricated to pivotally mount the various components.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A portable tool container comprising:

a generally cylindrically shaped base with a flat bottom and sides defining an upwardly opening main compartment;

a plurality of trays hingedly affixed to the sides of the base in opposed and stacked relationship for pivotal movement between a closed position overlying the upwardly opening main compartment and an open position in which the plurality of trays pivot outward from the sides of the base in different directions and operate as counterweights to maintain the base securely in an upright position; and a cover pivotally attached in overlying relationship to an upper one of the plurality of trays and pivotal between a closed position in which the cover overlies the upper one of the trays and an open position in which the cover extends outwardly to allow access to all of the plurality of trays.

2. A portable tool container as claimed in claim 1 wherein the generally cylindrically shaped base has a round cross-section.

3. A portable tool container as claimed in claim 1 wherein the plurality of trays includes two trays each having a plurality of minor compartments.

4. A portable tool container as claimed in claim 1 wherein the generally cylindrically shaped base with a flat bottom and sides is integrally formed of a single piece.

5. A portable tool container as claimed in claim 4 wherein the single piece is formed of plastic.

6. A portable tool container as claimed in claim 4 wherein each of the plurality of trays is hingedly affixed to the sides of the single piece base by means of one of a plurality of elongated, generally vertically extending ears formed on an outer surface of the sides, each ear having an opening extending longitudinally therethrough and each tray having an elongated vertically extending rod affixed to an outer edge thereof and removably engaged in the opening of an ear for pivotal movement of the tray about an axis through the rod.

7. A portable tool container as claimed in claim 6 wherein the plurality of ears are equally spaced about the sides of the generally cylindrically shaped base.

8. A portable tool container as claimed in claim 1 wherein the plurality of trays and the cover each have an opening defined therethrough which openings are coaxially aligned through the plurality of trays and the cover into the main compartment when the plurality of trays and the cover are all in the closed position.

9. A portable tool container as claimed in claim 8 including in addition a generally tubular member affixed within the main compartment in an upright orientation and further positioned to be coaxial with the coaxial openings in the plurality of trays and the cover in the closed position.

10. A portable tool container as claimed in claim 9 wherein the tubular member and the openings through the plurality of trays and the cover define an internal compartment in the closed position, which internal compartment is designed to receive an elongated tubular tank for a torch, the elongated tubular tank locking the plurality of trays and the cover in the closed position.

11. A portable tool container as claimed in claim 1 including in addition a pair of mating handle portions pivotally attached to an outer surface of the sides of the base for movement between an open and a closed position, the pair of mating handle portions being mounted to pivot into mutual engagement to form a single handle in the closed position and to hold the plurality of trays and the cover in closed positions and the pair of mating handle portions being mounted to pivot outwardly in the open position and allow the plurality of trays and the cover to pivot into the open position.

12. A portable tool container as claimed in claim 11 wherein the plurality of trays and the cover each have an opening defined therethrough which openings are coaxially aligned through the plurality of trays and the cover into the main compartment when the plurality of trays and the cover are all in the closed position.

13. A portable tool container as claimed in claim 12 including in addition a generally tubular member affixed within the main compartment in an upright orientation and further positioned to be coaxial with the coaxial openings in the plurality of trays and the cover in the closed position.

14. A portable tool container as claimed in claim 13 wherein the tubular member and the openings through the plurality of trays and the cover define an internal compartment in the closed position, which internal compartment is designed to receive an elongated tubular tank for a torch, the elongated tubular tank locking the plurality of trays and the cover in the closed position and the pair of handle portions engaging and locking the tubular tank in the internal compartment in the closed position.

15. A portable tool container comprising:

a generally cylindrically shaped base with a flat bottom and sides integrally formed of plastic and defining an upwardly opening main compartment;

a plurality of plastic trays hingedly affixed to the sides of the base in opposed and stacked relationship for pivotal movement between a closed position overlying the upwardly opening main compartment and an open position in which the plurality of trays pivot outward from the sides of the base in different directions and operate as counterweights to maintain the base securely in an upright position;

a cover pivotally attached in overlying relationship to an upper one of the plurality of trays and pivotal between a closed position in which the cover overlies the upper one of the trays and an open position in which the cover extends outwardly to allow access to all of the plurality of trays;

the plurality of trays and the cover each have an opening defined therethrough which openings are coaxially aligned through the plurality of trays and the cover into the main compartment when the plurality of trays and the cover are all in the closed position;

a generally tubular member affixed within the main compartment in an upright orientation and further positioned to be coaxial with the coaxial openings in the plurality of trays and the cover in the closed position, the tubular member and the openings through the plurality of trays and the cover defining an internal compartment in the closed position; and a pair of mating handle portions pivotally attached to an outer surface of the sides of the base for movement between an open and a closed position, the pair of mating handle portions being mounted to pivot into mutual engagement to form a single handle in the closed position and to hold the plurality of trays and the cover in closed positions and the pair of mating handle portions being mounted to pivot outwardly in the open position and allow the plurality of trays and the cover to pivot into the open position, the pair of mating handle portions further operating to prevent egress of objects positioned in the inner compartment.

16. A portable tool container as claimed in claim 15 including in addition a plurality of generally tubular member affixed within the main compartment in an upright orientation to form a plurality of secondary internal compartments for holding frequently used tools.

17. A portable tool container comprising:

a generally cylindrically shaped base with a flat bottom and sides integrally formed of plastic and defining an upwardly opening main compartment, the main compartment defining a generally vertical main axis;

a plurality of trays hingedly affixed to the sides of the base in opposed and stacked relationship, each tray being mounted for pivotal movement about an individual axis parallel to the main axis and positioned adjacent an outer surface of the sides, the individual axes of the plurality of trays further being substantially equally spaced about the base, each tray being pivotal between a closed position overlying the upwardly opening main compartment and an open position in which the plurality of trays pivot outward from the sides of the base in different directions and operate as counterweights to maintain the base securely in an upright position; and a cover pivotally attached in overlying relationship to an upper one of the plurality of trays and pivotal between a closed position in which the cover overlies the upper one of the trays and an open position in which the cover extends outwardly to allow access to all of the plurality of trays.

18. A portable tool container as claimed in claim 17 wherein the plurality of trays and the cover each have an opening defined therethrough which openings are coaxially aligned through the plurality of trays and the cover into the main compartment when the plurality of trays and the cover are all in the closed position and including in addition a generally tubular member affixed within the main compartment in an upright orientation and further positioned to be coaxial with the coaxial openings in the plurality of trays and the cover in the closed position.

19. A portable tool container as claimed in claim 18 wherein the tubular member and the openings through the plurality of trays and the cover define an internal compartment in the closed position, which internal compartment is designed to receive an elongated tubular tank for a torch, the elongated tubular tank locking the plurality of trays and the cover in the closed position.

20. A portable tool container as claimed in claim 19 including in addition a pair of mating handle portions pivotally attached to an outer surface of the sides of the base for movement between an open and a closed position, the pair of mating handle portions being mounted to pivot into mutual engagement to form a single handle in the closed position and to hold the plurality of trays and the cover in closed positions and the pair of mating handle portions being mounted to pivot outwardly in the open position and allow the plurality of trays and the cover to pivot into the open position and the pair of handle portions engaging and locking the tubular tank in the internal compartment in the closed position.

* * * * *